US006648452B2

(12) United States Patent
Ito

(10) Patent No.: US 6,648,452 B2
(45) Date of Patent: Nov. 18, 2003

(54) MANIFOLD PLATE OF INK JET HEAD

(75) Inventor: Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/983,973

(22) Filed: Oct. 26, 2001

(65) Prior Publication Data

US 2002/0051038 A1 May 2, 2002

(30) Foreign Application Priority Data

Oct. 31, 2000 (JP) ..... 2000-332808
Oct. 31, 2000 (JP) ..... 2000-332809

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS

2002/0024560 A1 * 2/2002 Misumi et al. ..... 347/57

FOREIGN PATENT DOCUMENTS

JP 2000-43253 A 2/2000

OTHER PUBLICATIONS

U.S. patent application Ser. No. 09/897,394, Isono et al., filed Jul. 3, 2001.

U.S. patent application Ser. No. 09/933,155, Ito et al., filed Aug. 21, 2001.

U.S. patent application Ser. No. 09/933,156, Ito et al., filed Aug. 21, 2001.

U.S. patent application Ser. No. 09/956,991, Ito et al., filed Sep. 21, 2001.

* cited by examiner

*Primary Examiner*—Raquel Yvette Gordon
(74) *Attorney, Agent, or Firm*—Oliff & Berridge, PLC

(57) ABSTRACT

Manifold plates 12 are formed with common ink chambers 12*a*, 12*b* with protrusions 51 and open-space chambers 50. When a cap 81 abuts against a nozzle surface 43 of a base plate 11 at position shifted from a proper position, the protrusions 51 offer support for the cap 81. Accordingly, an ink jet head 6 can be configured to properly withstand the capping operation without adding any capping margin. End portions of the common ink chambers 12*a*, 12*b* adjacent to portions D are formed to have a cross-sectional area that decreases at a fixed rate in association with distance from ink supply holes 19*a*, 19*b*. The open-space chambers 50 are shaped for correcting differences in strength in the manifold plates 12 with respect to a lengthwise direction D1.

27 Claims, 14 Drawing Sheets

MANIFOLD PLATE OF INK JET HEAD

BACKGROUND OF THE INVENTION

1. Field of the Invention

The present invention relates to an ink jet printing device.

2. Description of the Related Art

Conventional ink jet printing devices, such as ink jet printers, include an ink jet head and a cap. The ink jet head includes a plurality of nozzles, a plurality of pressure chambers, common ink chambers, and an actuator. Each nozzle is open to outside the ink jet head. The pressure chambers are provided in a one-to-one correspondence with the nozzles and supply the nozzles with ink. The common ink chambers in turn supply all of the pressure chambers with ink through ink supply holes. The actuator includes a plurality of pressure generating portions in a one-to-one correspondence with the pressure chambers. The pressure generating portions apply pressure to the pressure chambers in order to eject ink from the pressure chambers. The cap is for abutting against the ink jet head so as to cover the nozzles.

The common ink chambers are positioned within a plane that is parallel with a plane defined by the plurality of pressure chambers. The common ink chambers are elongated in an alignment direction in which the pressure chambers are aligned and overlap with at least a portion of each pressure chamber in a direction perpendicular to the above-described plane. Each common ink chamber is shaped so that its cross-sectional area is substantially constant at all points in the alignment direction, that is, from the vicinity of the ink supply source to the farthest from the ink supply source.

However, when the common ink chambers are formed in this shape, air bubbles can easily become trapped at the end of the common ink chambers farthest from the ink supply source. These air bubbles can result in defective ejection of ink and can also obstruct refill of ink into the pressure chambers.

Japanese Patent Application Publication No. 2000-43253, for example, discloses an ink jet recording head with common ink chambers 120 with the shape shown in FIG. 1. As shown in FIG. 1, each common ink chamber 120 is shaped so that its cross-sectional area at a far-end side 121, which is the portion of the common ink chamber 120 that is farthest from an ink supply source 130, decreases at a fixed rate with distance from the ink supply source 130. This configuration helps discharge bubbles that accumulate at the far-end side 121.

However, when the common ink chamber 120 is shaped in this way, the strength of the ink chamber member 112, in which the common ink chambers 120 are formed, varies depending on the position in the alignment direction Dl of the nozzles 150. As a result, the ink chamber member 112 has different strength at different positions corresponding to different nozzles 150. For example, as shown in FIG. 2 the common ink chambers 120 have a larger cross-sectional area in a region A than in a region B. As a result, the ink chamber member 112 is weaker at the region A than at the region B.

As a result, the ink chamber member 112 more easily deforms at the weaker area in the region A, so that the pressure applied to the pressure chambers is partially absorbed by the region A. As a result, the pressure chambers that correspond to the region A have different ink ejection performance than the pressure chambers that correspond to the region B.

As shown in FIG. 1, a cap 810 is provided to cover the nozzles 150 of the ink jet head. When the cap 810 is in intimate contact with the ink jet head, the cap 810 is positioned not to overlap with the common ink chambers 120 in directions perpendicular to the plane defined by the common ink chambers 120. This positioning enables the ink jet head to withstand capping pressure from the cap 810.

However, this optimum positioning of the cap 810 is often not achieved for various reasons, for example because the common ink chambers 120 themselves can be shifted out of position by, for example, variations in assembly of the ink jet head. A capping margin C is designed into the ink jet head to take potential shift in position of the cap 810 into account. The capping margin C is secured by locating the common ink chambers 120 near the outer edges of the ink chamber member 112, away from the nozzles 150 in a direction D2 that is perpendicular to the alignment direction Dl. However, when the ink jet head needs to be quite small, it is often impossible to provide the capping margin C and at the same time secure sufficient volume for the common ink chambers 120.

SUMMARY OF THE INVENTION

It is an objective of the present invention to overcome the above-described problem and provide an ink jet print head capable of uniform ink ejection performance at all pressure chambers.

It is another objective of the present invention to provide an ink jet recording device with a small ink jet head that is also capable of securing sufficient volume for the common ink chambers.

In order to achieve the above and other objectives, there is provided an ink jet head including a cavity plate. The cavity plate is formed with a row of plurality of nozzles, a plurality of pressure chambers in one-to-one correspondence with the plurality of nozzles, a common chamber located between the nozzles and the pressure chambers, and a protrusion protruding into the common chamber. The common chamber distributes ink to the respective pressure chambers.

There is also provided an ink jet printer including the above ink jet head and a purging unit including a cap that covers over the row of the nozzles. The protrusion of the cavity plate serves as a support for the cap.

Further, there is also provided an ink jet head including a cavity plate. The cavity plate is formed with a row of a plurality of nozzles defining a first plane, a plurality of pressure chambers in one-to-one correspondence with the plurality of nozzles, a common chamber located between the row of the plurality of nozzles and the plurality of pressure chambers for distributing ink to the respective pressure chambers, an ink supply hole for introducing ink to the common chamber, and an open-space chamber. The common chamber defines a second plane parallel to the first plane. The ink supply hole introduces ink to the common chamber. The common chamber has an end portion with a smaller cross section with a distance from the ink supply hole. The open-space chamber is formed in adjacent to the end portion of the common chamber in the second plane defined by the common chamber.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENT

Next, a color ink jet printer 100 according to an embodiment of the present invention will be explained.

It should be noted that the following explanation of the embodiment will be easier to understand by referring to U.S. patent application Ser. Nos. 09/897,394; 09/933,155; 09/933,156; and U.S. patent application titled LAMINATED AND BONDED CONSTRUCTION OF THIN PLATE PARTS filed with the U.S. Patent and Trademark Office on Sep. 21, 2001, the disclosure of all of which is incorporated herein by reference in their entirety.

Figure 1:
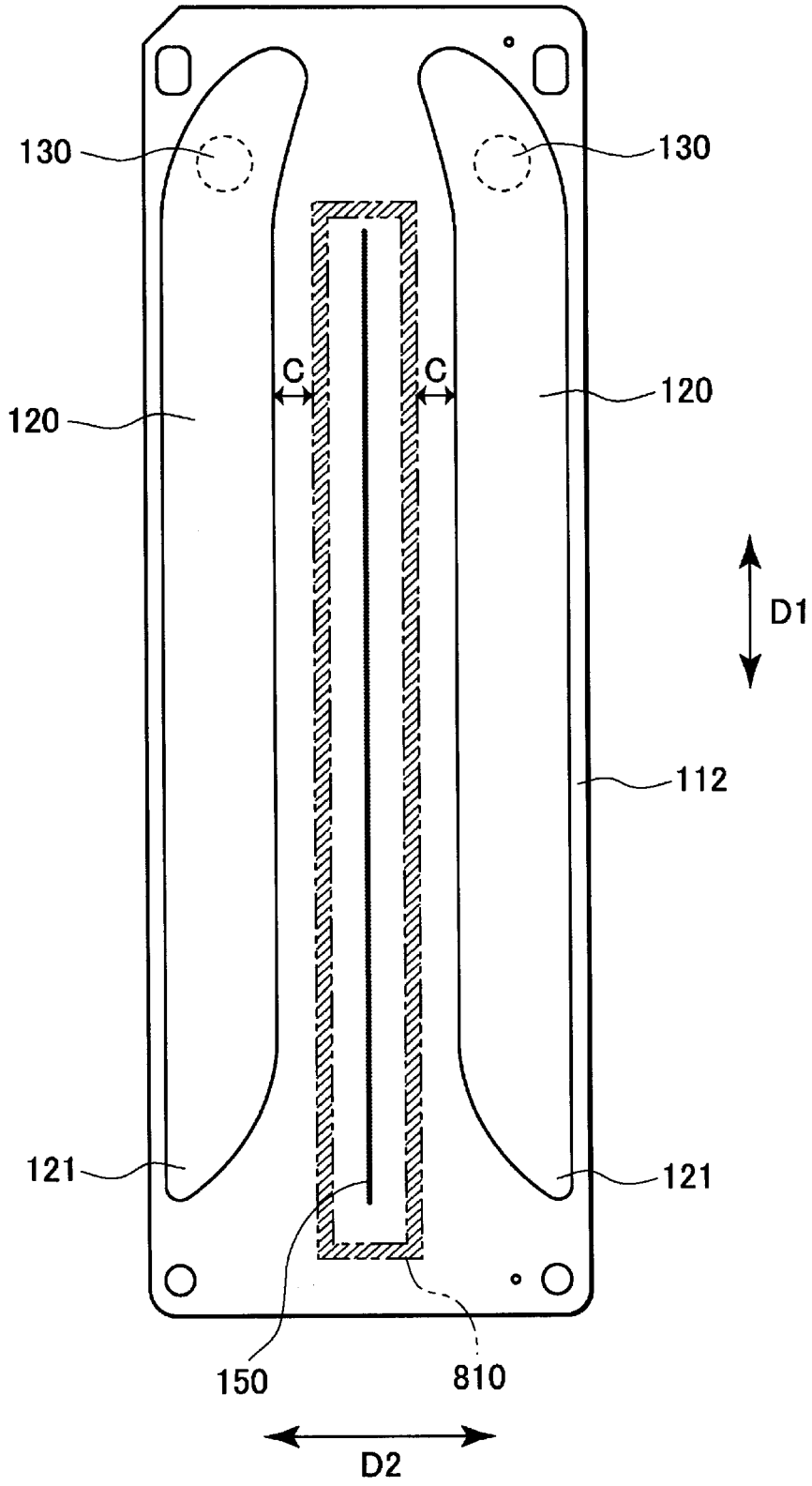
FIG. 1 is a plan view showing a common ink chamber member of a conventional ink jet head.
Figure 2:
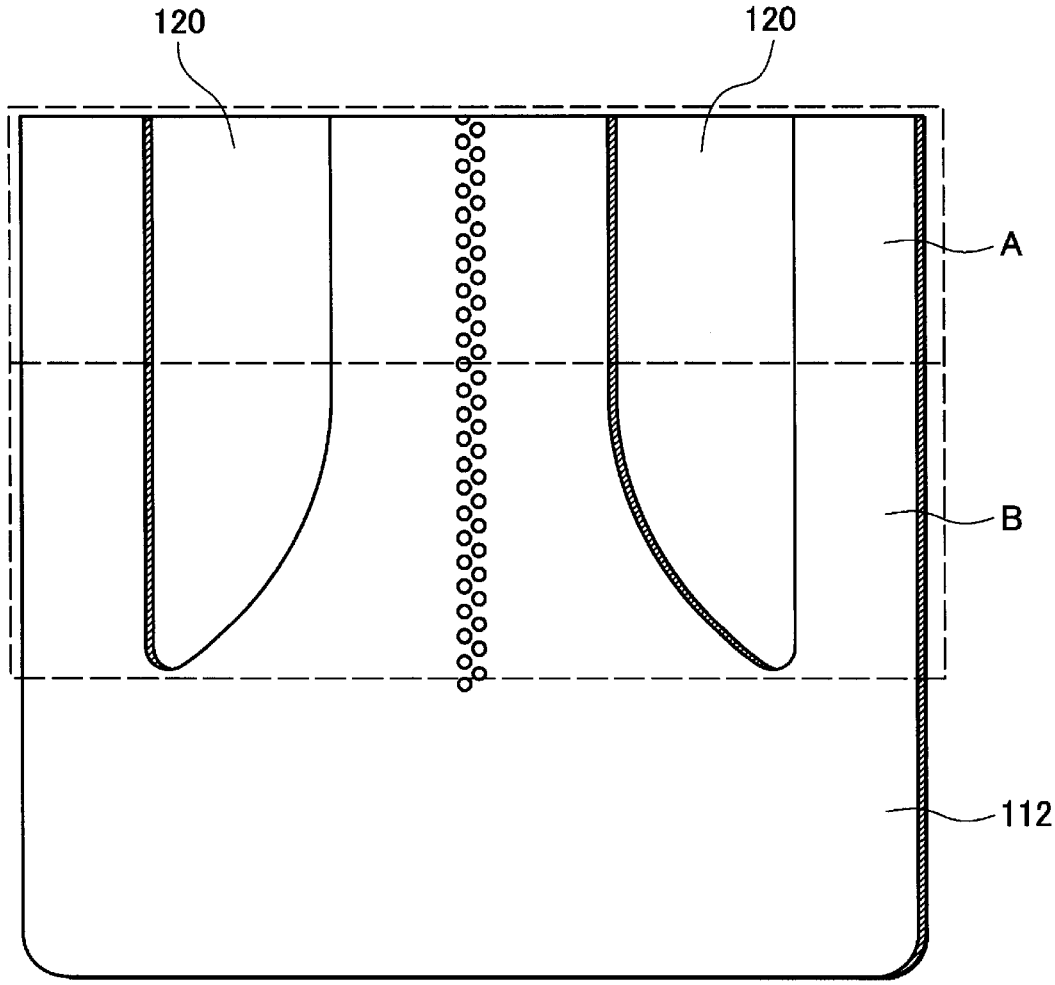
FIG. 2 is a magnified view showing details of common ink chambers formed in the member of FIG. 1.
Figure 3:
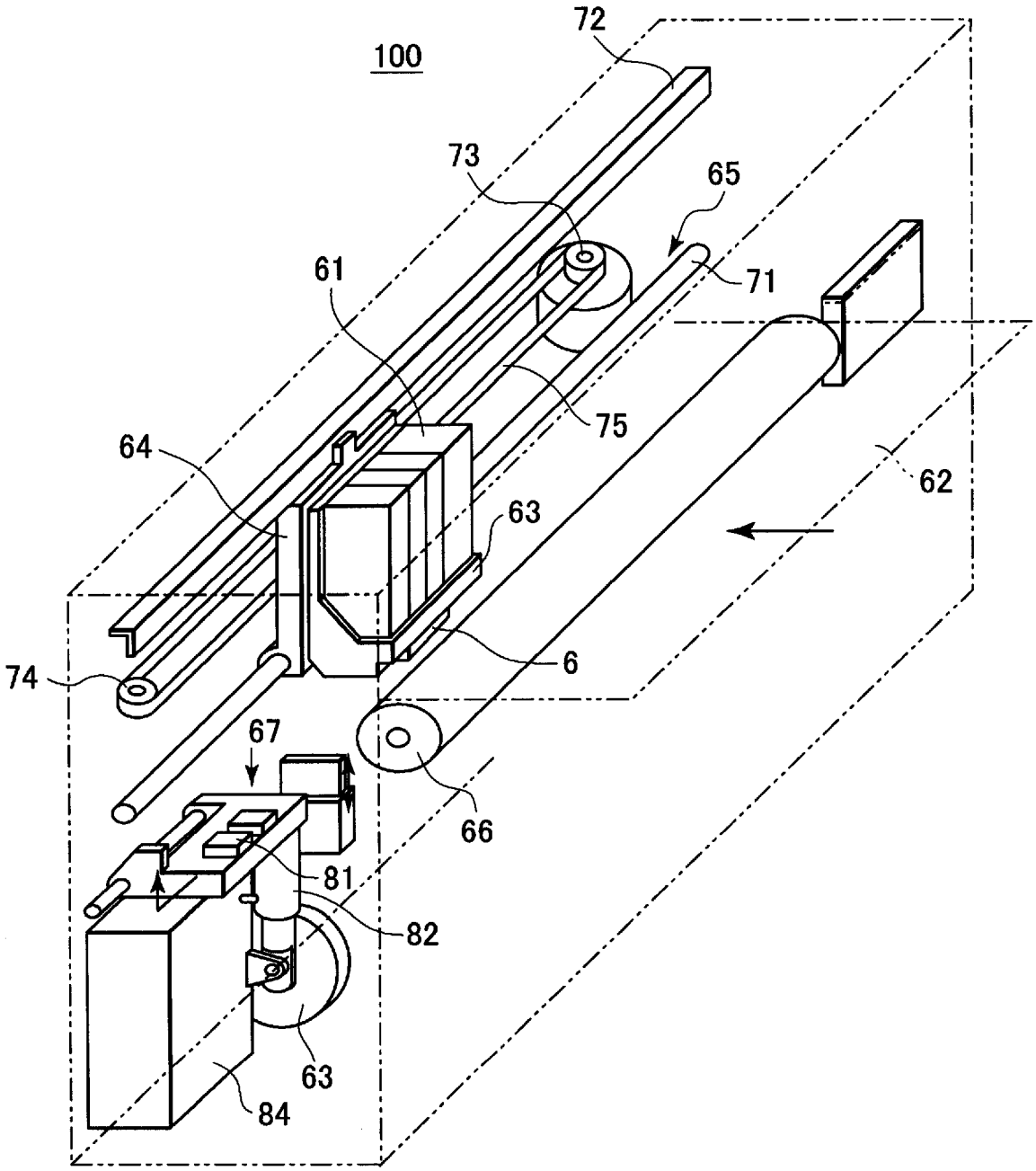
FIG. 3 is a perspective view in partial phantom showing a color ink jet printer according to an embodiment of the present invention.

As shown in FIG. 3, the printer 100 includes a head unit 63, a carriage 64, a drive unit 65, a platen roller 66, and a purge unit 67. The head unit 63 is mounted on the carriage 64 and includes ink cartridges 61 and a pair of piezoelectric ink jet heads 6. The ink cartridges 61 are each filled with one of four different colors of ink, for example, cyan, magenta, yellow, or black ink. The ink jet heads 6 are for printing ink images onto a paper sheet 62 with ink from the ink cartridges 61. The drive unit 65 drives the carriage 64 to move reciprocally and linearly. The platen roller 66 is positioned in confrontation with the ink jet heads 6 and extends in the reciprocal movement direction of the carriage 64.

The drive unit 65 includes a carriage shaft 71, a guide plate 72, two pulleys 73, 74, and an endless belt 75. The carriage shaft 71 extends parallel with the platen roller 66. The lower end of the carriage 64 is slidingly engaged with the carriage shaft 71. The guide plate 72 extends parallel with the carriage shaft 71 at the upper edge of the carriage 64. Each of the pulleys 73, 74 is disposed adjacent to one of the ends of the carriage shaft 71 at a position between the carriage shaft 71 and the guide plate 72. The endless belt 75 extends between the pulleys 73, 74.

When a motor 76 drives the pulley 73 to rotate in forward and reverse directions, the carriage 64, which is connected to the endless belt 75, moves reciprocally in association with forward and reverse movement of the pulley 73 and linearly following the carriage shaft 71 and the guide plate 72.

Although not shown in the drawings, a sheet-supply cassette that supplies the paper sheet 62 is provided at the side of the printer 100. The sheet-supply cassette introduces the paper sheet 62 between the ink jet heads 6 and the platen roller 66. The ink jet heads 6 are driven to eject ink to print characters and the like onto the paper sheet 62. The paper sheet 62 is then discharged from the printer 100. It should be noted that mechanisms for supplying and discharging the paper sheet 62 are omitted from FIG. 3.

The purge unit 67 is provided to the side of the platen roller 66 at a position where the ink jet heads 6 will confront the purge unit 67 when the head unit 63 is in the reset position. The purge unit 67 includes caps 81, a pump 82, a cam 83, and an ink tank 84. The purge unit 67 performs a purging operation on the ink jet heads 6 when the head unit 63 is in the reset position. During the purging operation, first the caps 81 are driven to cover the nozzles of the ink jet heads 6. Then, the cam 83 is driven to drive the pump 83 to suck defective ink, which includes bubbles and other undesirable matter, from the ink jet heads 6. The sucked-out defective ink and the like is stored in the ink tank 84. This purging operation recovers the ink jet heads 6 to a good ink ejection condition, and prevents defective ejection of ink that can be caused when bubbles develop or are introduced into ink when ink is initially introduced into the ink jet heads 6.

Details of the head unit 63 will be described while referring to FIGS. 4 to 7. As shown in FIG. 6, the head unit 63 includes a mounting portion 3, the ink jet heads 6, a bottom plate 5, and a cover 44. The mounting portion 3 has a substantial box shape with the upper surface open, and mounts the four ink cartridges 61 in a freely detachable manner. The mounting portion 3 includes an upper surface 3*a* formed with ink supply holes 4*a*, 4*b*, 4*c*, 4*d* that penetrate through to the bottom plate 5. The ink supply holes 4*a*, 4*b*, 4*c*, 4*d* are for connecting with an ink outlet portion (not shown) of the ink cartridge 61. Although not shown in the drawings, packing is provided at the upper surface 3*a* for developing an intimate sealed condition with the ink outlet portion of the ink cartridges 61. The packing can be made from rubber, for example.

Figure 4:
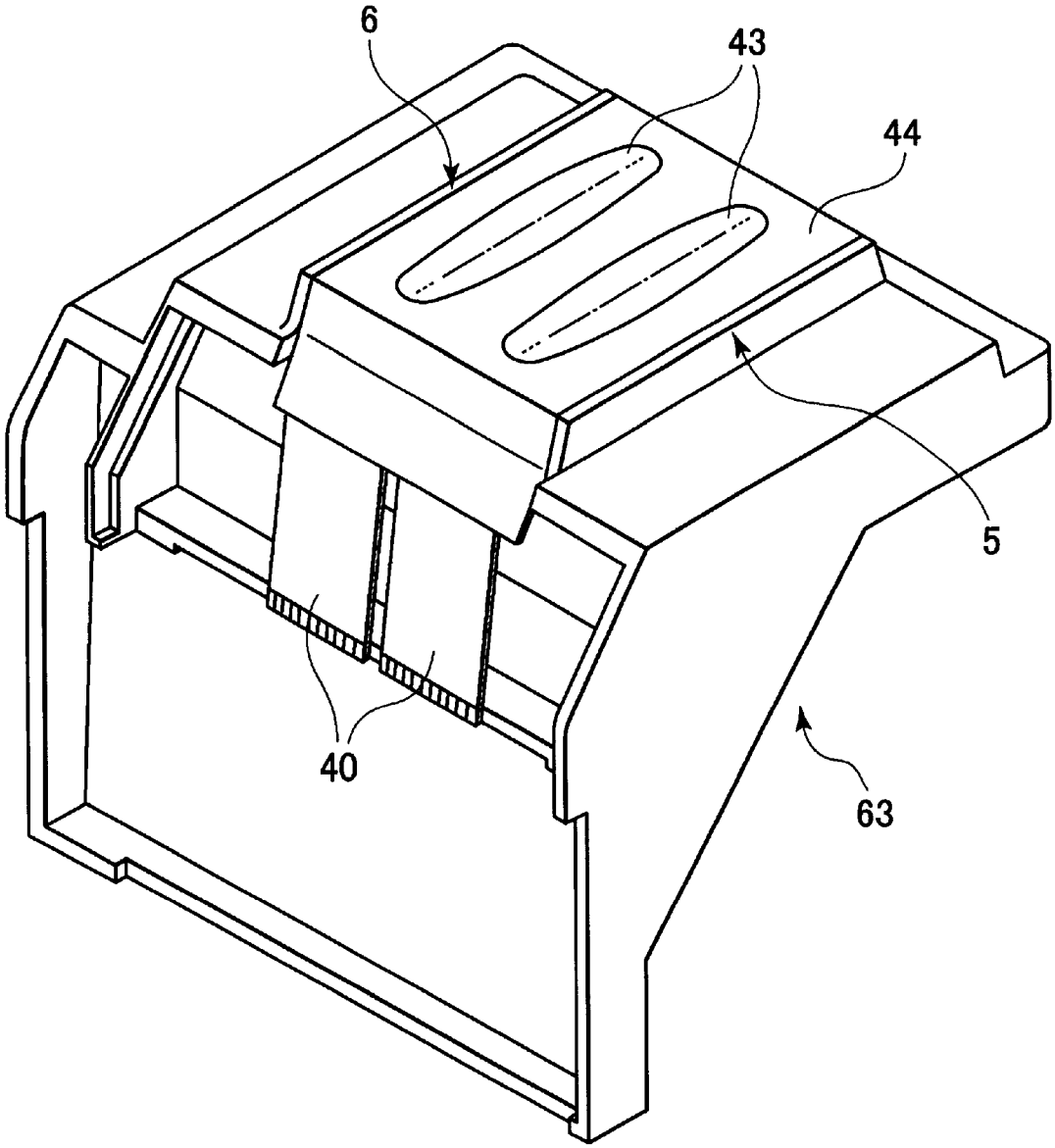
FIG. 4 is a perspective view showing the bottom of a head unit of the ink jet printer of FIG. 1.
Figure 5:
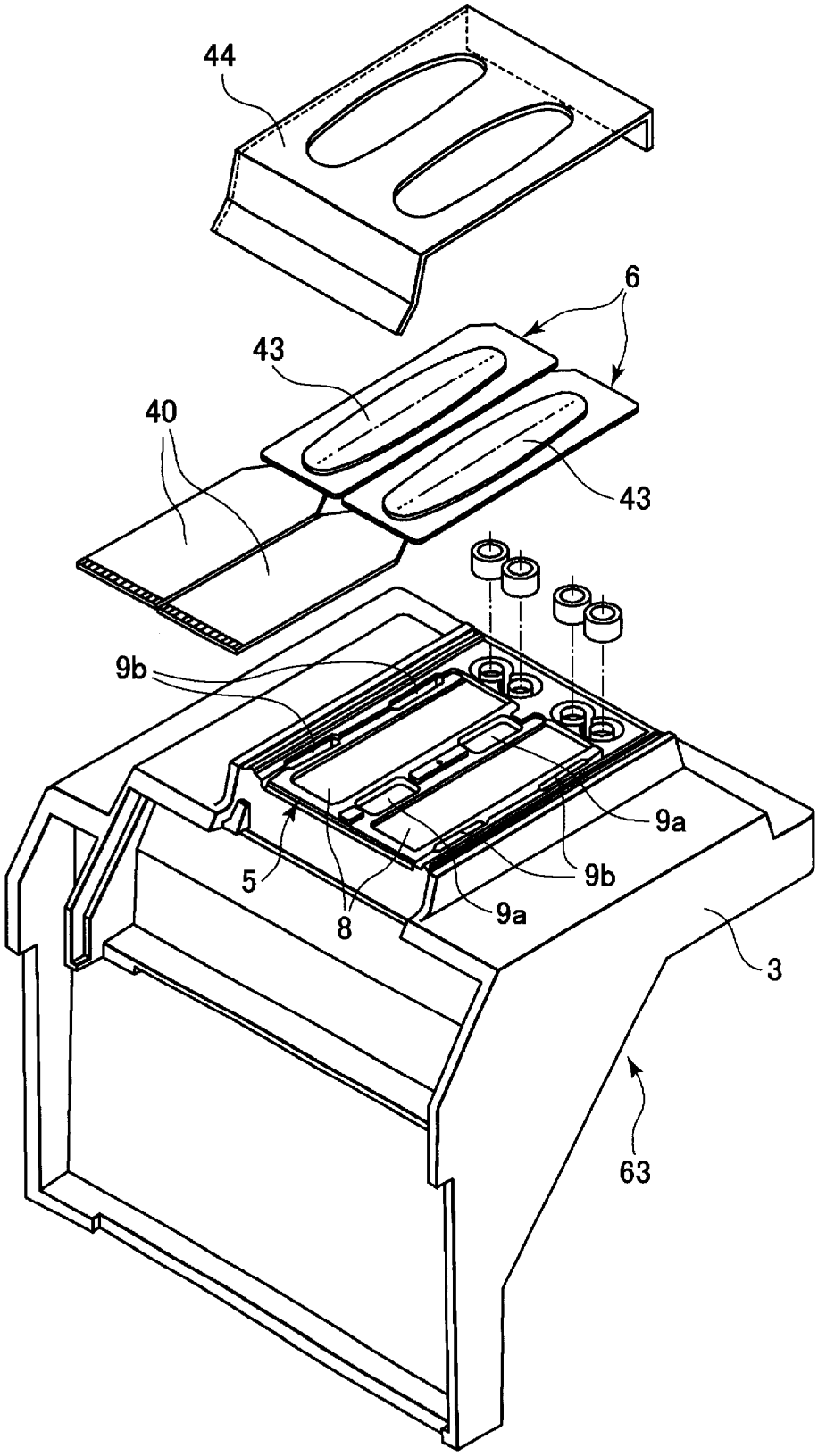
FIG. 5 is an exploded perspective view showing the head unit of FIG. 4.
Figure 6:
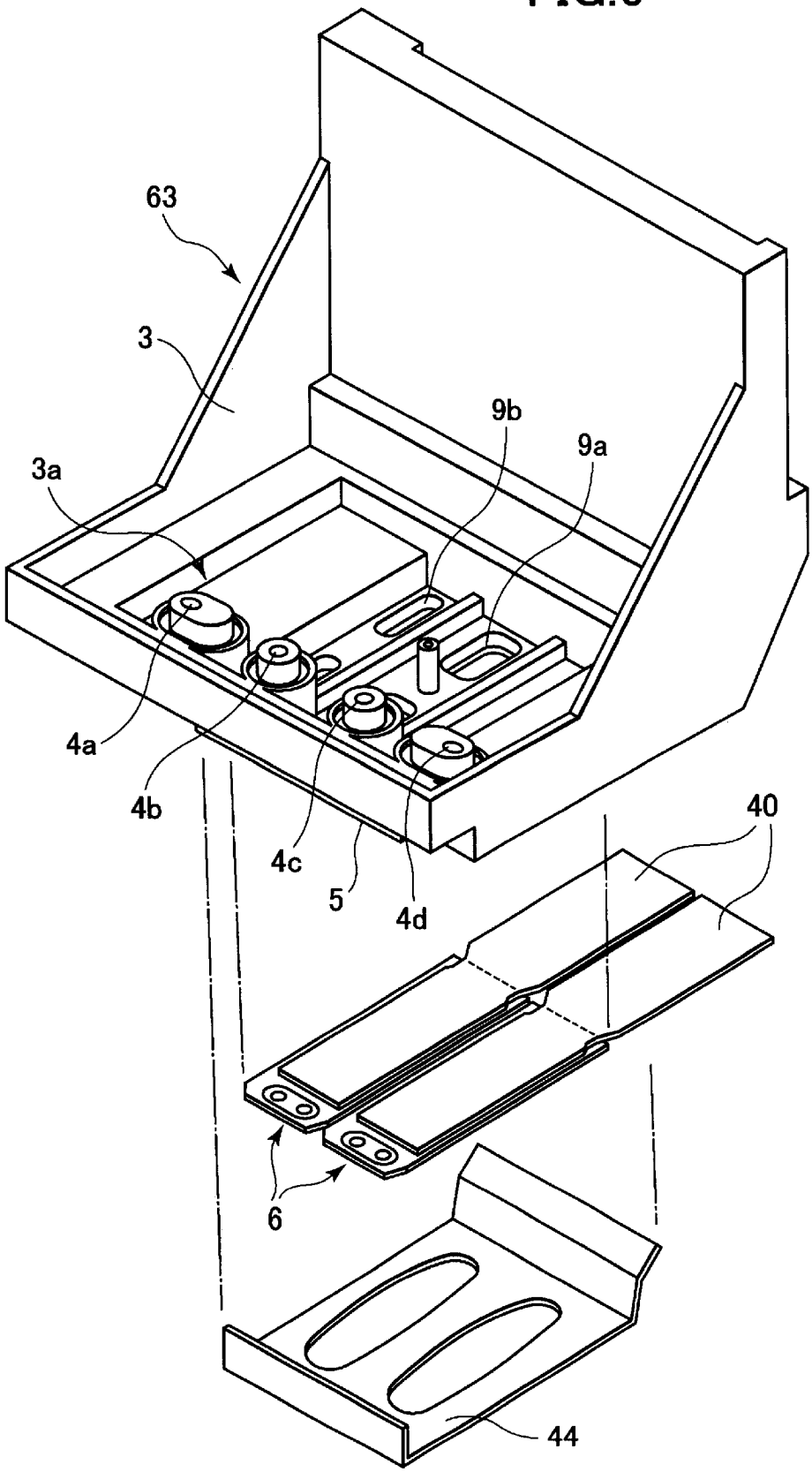
FIG. 6 is an exploded perspective view showing the upper portion of the head unit of FIG. 4.
Figure 7:
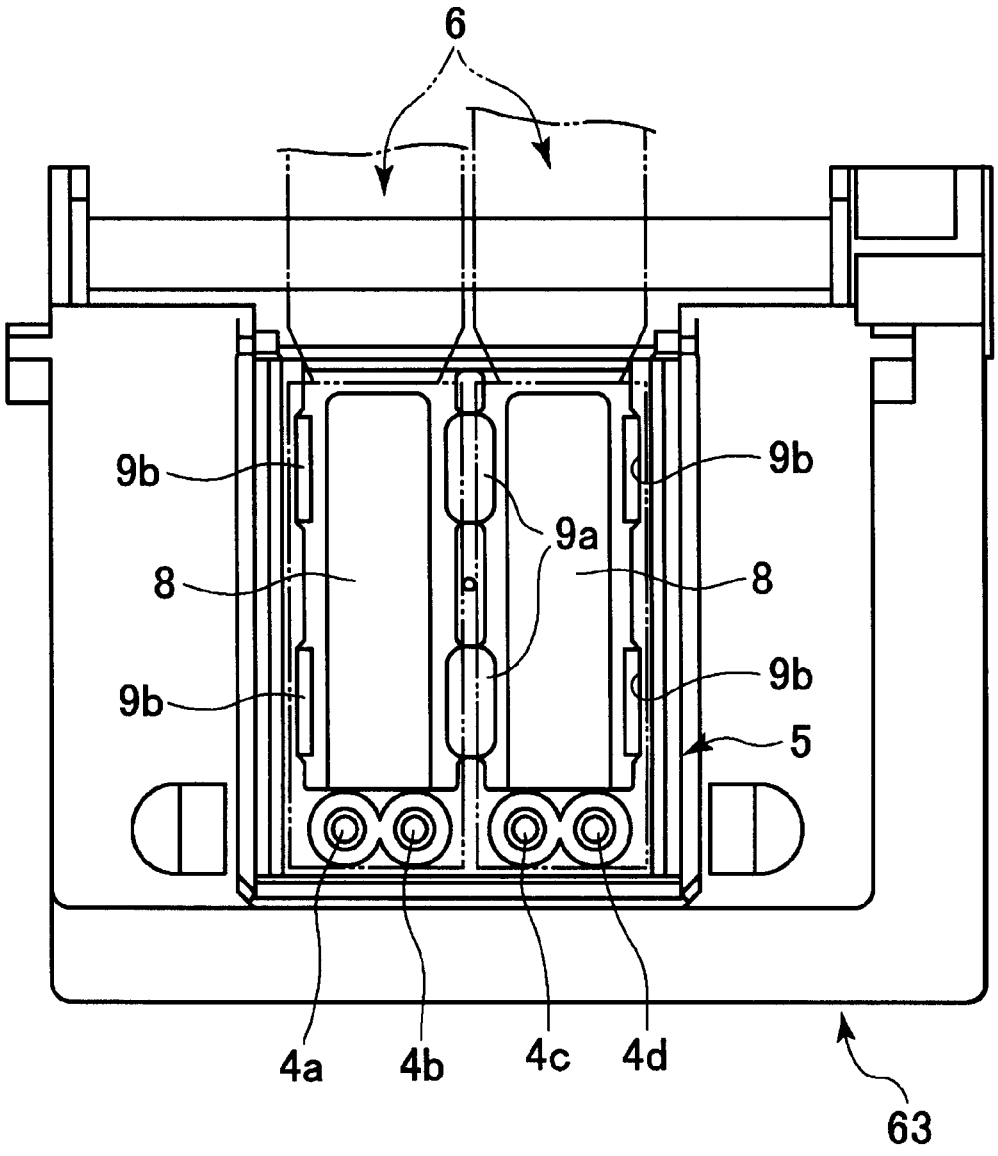
FIG. 7 is a plan view showing the head unit.

As shown in FIGS. 4 and 5, the bottom plate 5 protrudes from the mounting portion 3 in the manner of a step with a flat surface. As shown in FIGS. 5 and 7, two support portions 8 are formed with a step-like level difference in the lower surface of the bottom plate 5. The ink jet heads 6 have nozzle surfaces 43 and are supported at the two support portions 8 while the nozzle surfaces 43 are exposed outside through windows of the cover 44. A plurality of empty portions 9*a*, 9*b* that penetrate vertically through the support portions 8 are formed in the support portions 8. The empty portions 9*a*, 9*b* are for holding UV adhesive for fixing the ink jet heads 6 in place.

Figure 8:
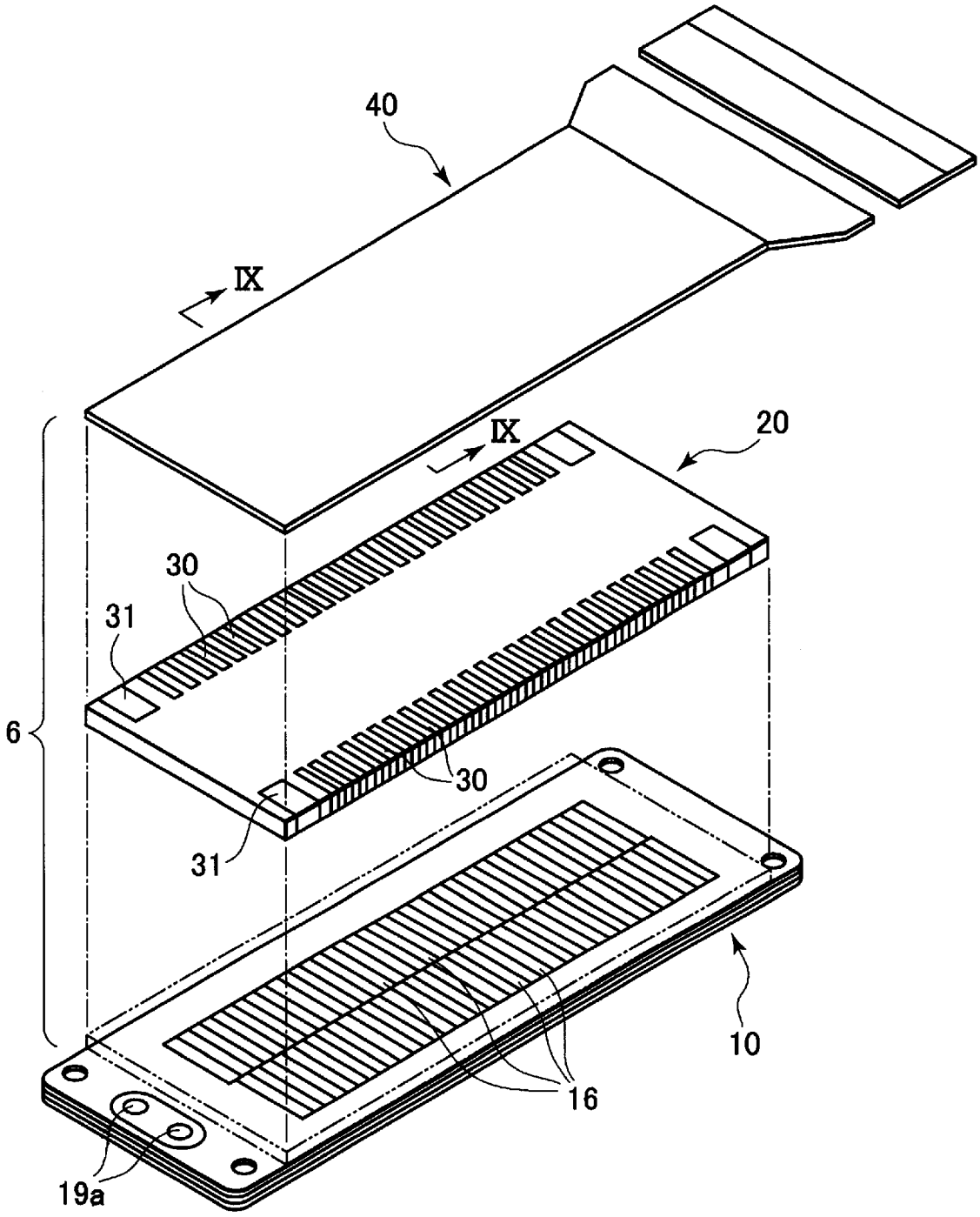
FIG. 8 is an exploded perspective view showing an ink jet head of the head unit.
Figure 9:
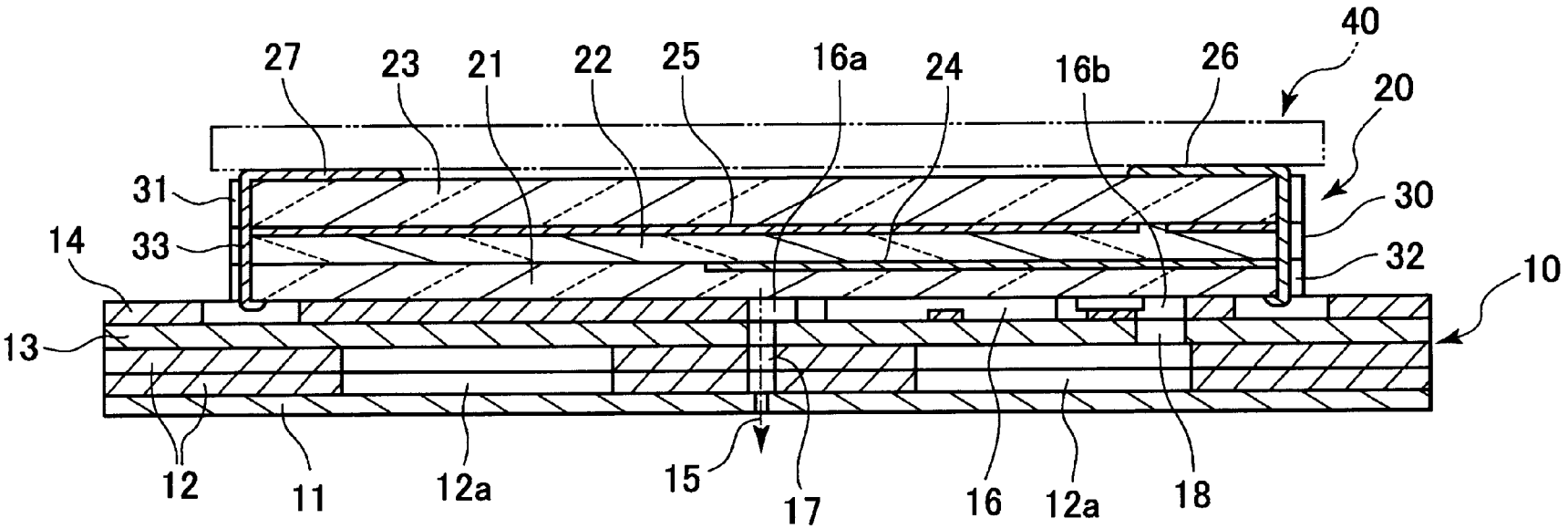
FIG. 9 is a cross-sectional view taken along IX—IX of FIG. 8.

Next, the ink jet heads 6 will be described. Because the ink jet heads 6 have the same configuration, only one of which will be described. As shown in FIGS. 8 and 9, each jet head 6 includes a cavity plate 10, a plate-shaped piezoelectric actuator 20, and a flexible flat cable 40, which are adhered together in a stack. The cavity plate 10 is a stack of a plurality of layers. The actuator 20 is adhered in a stacked condition onto the cavity plate 10 by adhesive or an adhesive sheet. The flexible flat cable 40 is stacked on the actuator 20 and is for electrically connecting the ink jet head 6 to external equipment. The nozzles 15 are opened in the lower surface of the cavity plate 10, which is the lowermost layer of the ink jet head 6, and eject ink downward.

Figure 10:
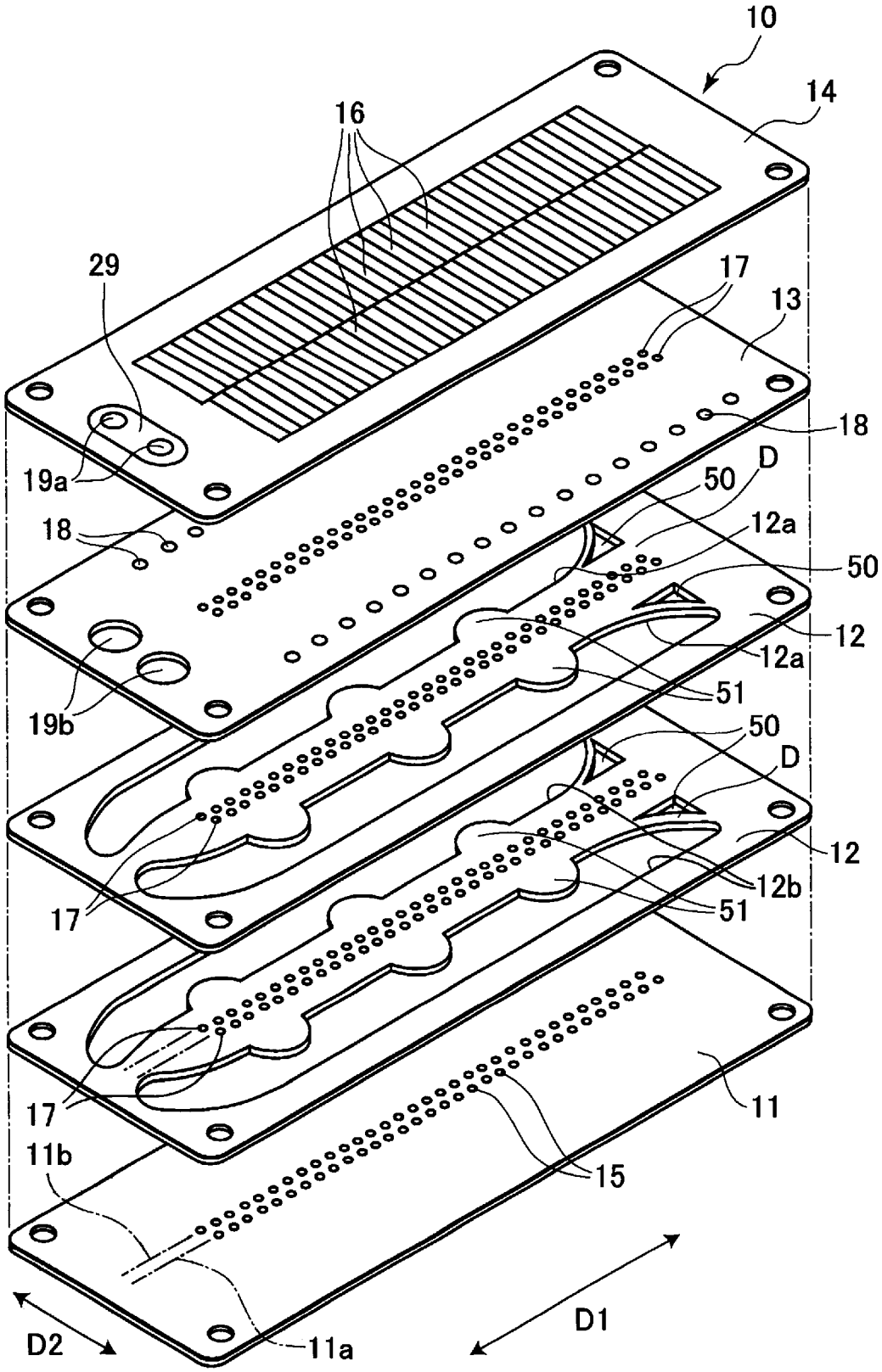
FIG. 10 is an exploded perspective view showing a cavity plate of the ink jet head.
Figure 11:
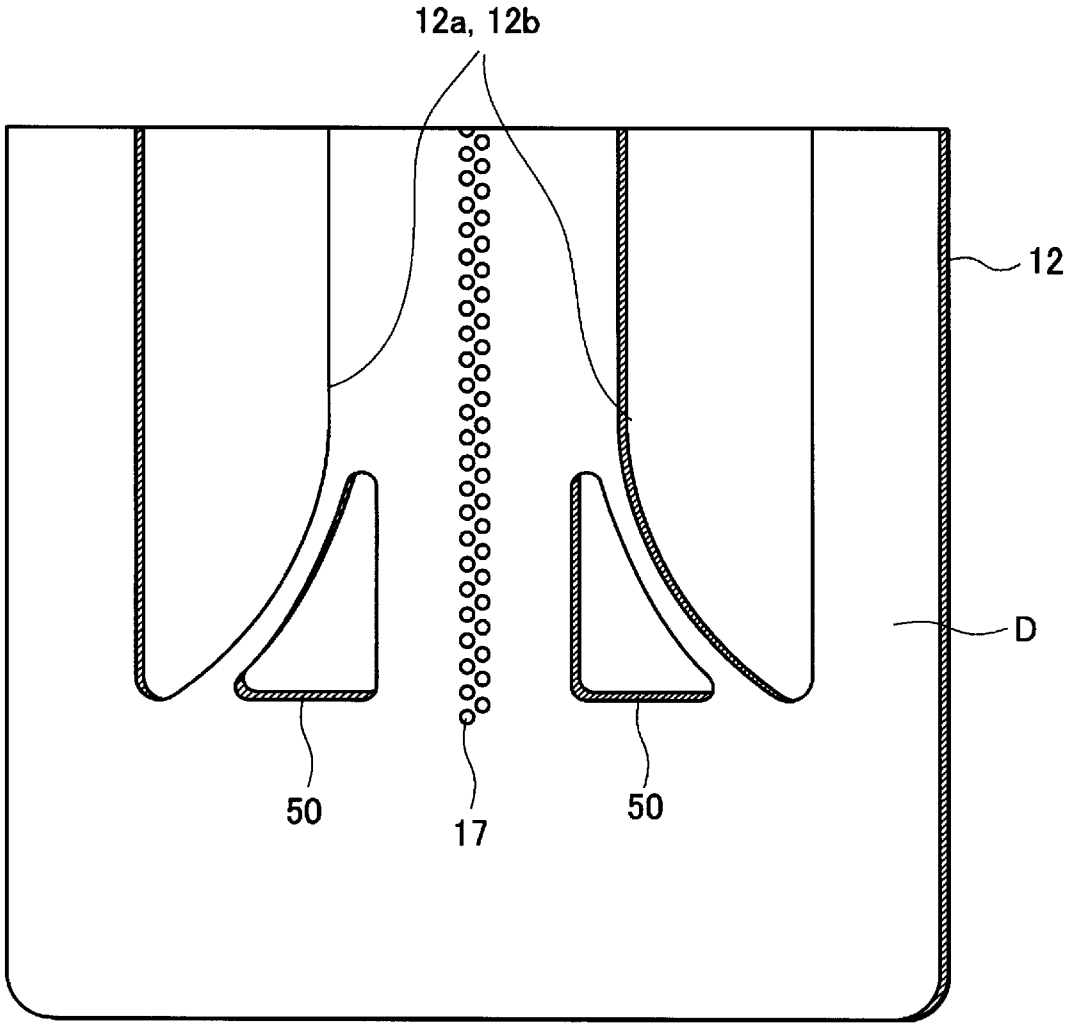
FIG. 11 is a magnified plan view showing an end portion of a manifold plate of the cavity plate.

Detailed description for the cavity plate 10 will be provided. As shown in FIG. 10, the cavity plate 10 includes five thin-metal plates, which are connected together in a laminated manner by adhesive. The five plates include a nozzle plate 11, two manifold plates 12, a spacer plate 13, and a base plate 14. The plates 11 to 14 have a thickness of between 50 μm to 150 μm and are formed from a 42% nickel/steel alloy (42 alloy). It should be noted that the plates 11 to 14 need not be produced from metal, but could be formed from resin instead.

Figure 12:
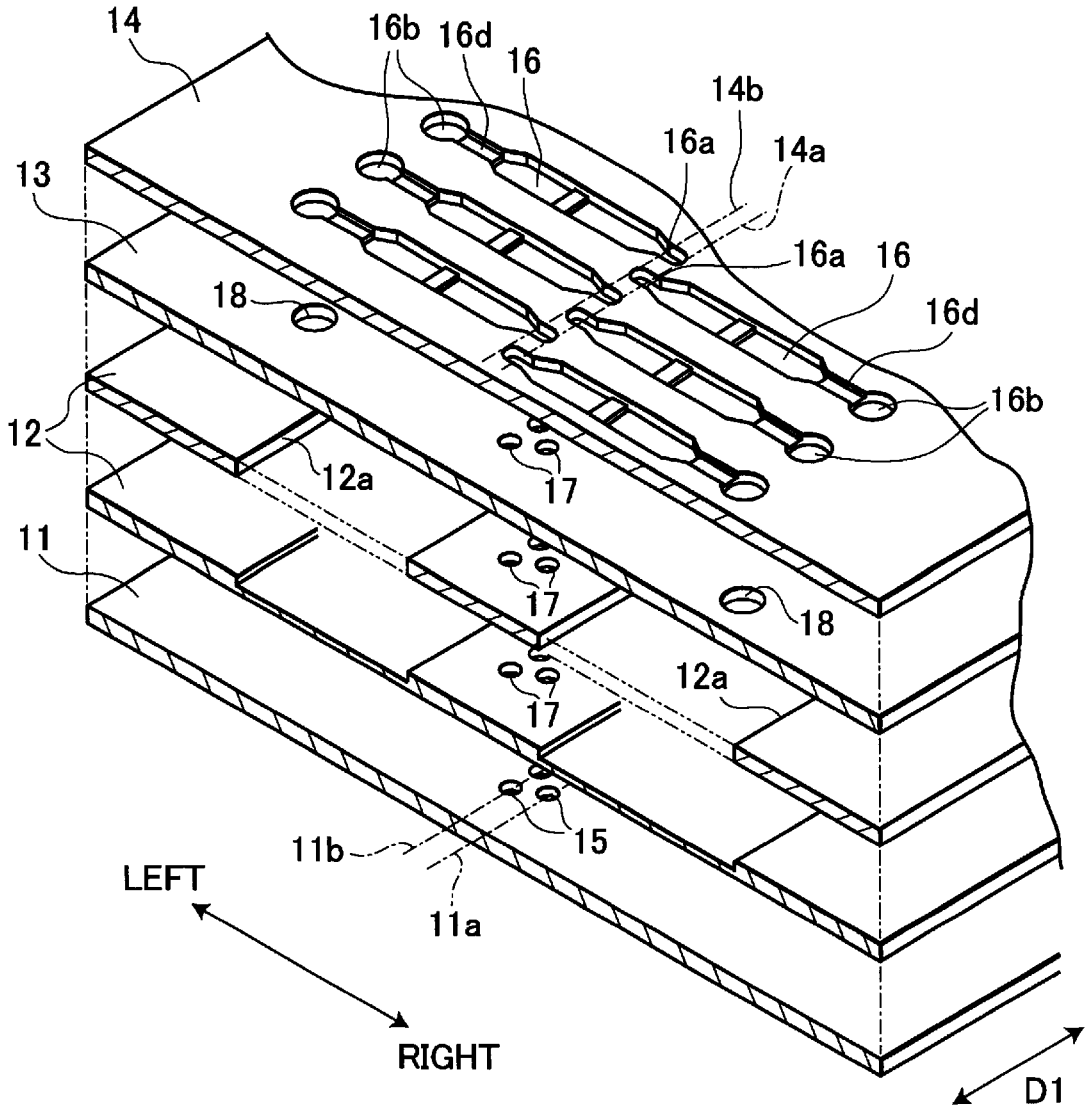
FIG. 12 is an exploded perspective view showing a magnified view of one end of the cavity plate.

As shown in FIGS. 10 and 12, narrow-width pressure chambers 16 are formed in the base plate 14 in a staggered arrangement in two rows that extend parallel with imaginary lines 14*a*, 14*b*, which extend in the center of the base plate 14 following the lengthwise direction D1 of the base plate 14. An ink supply hole 16*b* for each pressure chamber 16 is formed through the base plate 14. Narrow portions 16*d* are formed in the base plate 14 for bringing the corresponding pressure chamber 16 into fluid connection with a corresponding ink supply hole 16*b*. The narrow portions 16*d* are formed with a cross-sectional area, that is, of a cross section taken in perpendicular to the flow of ink, that is smaller than the cross-sectional area of the pressure chambers 16, in order to increase resistance to the flow of ink. Ink supply holes 18 are formed through the left and right sides of the spacer plate 13 at positions aligned with the ink supply holes 16*b*.

The nozzle plate 11 has a flat nozzle surface 43. Nozzles 15 are formed through the nozzle plate 11 separated from each other by a pitch P in two rows aligned following central imaginary lines 11*a*, 11*b* that extend in the lengthwise direction D1. The rows of nozzles 15 are shifted slightly in the lengthwise direction D1 to give the nozzles 15 a staggered arrangement. The nozzles 15 have a diameter of 25 μm according to the present embodiment. Small-diameter through holes 17 are formed through the spacer plate 13 and the two manifold plates 12 in the same staggered arrangement as the nozzles 15. The inward facing tip 16*a* of each pressure chamber 16 is in fluid connection with one of the nozzles 15 through the corresponding through holes 17. Ink supply holes 19*a*, 19*b* are formed through the base plate 14 and the spacer plate 13.

Two common ink chambers 12*a* and 12*b* are formed through each of the two manifold plates 12 at positions sandwiching the rows of through holes 17. The common ink chambers 12*a*, 12*b* are sealed off by the nozzle plate 11 and the spacer plate 13 laminated on either side of the two manifold plates 12. The ink supply holes 16*b* are in fluid connection with corresponding common ink chambers 12*a*, 12*b* through the ink supply holes 18. The common ink chambers 12*a*, 12*b* are positioned within a plane that is parallel to the nozzle surface 42. The common ink chambers 12*a*, 12*b* are formed to have lengthwise ends positioned adjacent to end portions D of the manifold plates 12 and to extend further than the rows of nozzles 15 in the direction D1.

With this configuration, ink supplied from the ink cartridge 61 flows through the ink supply holes 19*a*, 19*b* into the common ink chambers 12*a*, 12*b*, distributed through the ink supply holes 18, the ink supply holes 16*b*, and the narrow portions 16*d* to the pressure chamber 16. The ink further flows toward the end 16*a* of the pressure chambers 16, through the through holes 17, and to the nozzles 15 that correspond to the pressure chambers 16.

The manifold plats 12 will be further described. The end portions of the common ink chambers 12*a*, 12*b* adjacent to the portion D are formed to have a cross-sectional area that decreases at a fixed rate in association with distance from the ink supply holes 19*a*, 19*b*. This facilitates discharge of residual air bubbles, which can easily accumulate in the end portions of the common ink chambers 12*a*, 12*b* adjacent to the end portions D.

As shown in FIGS. 10 and 12, open-space chambers 50 are also formed through the two manifold plates 12 at the end portions D. The open-space chambers 50 are shaped for correcting differences in strength in the manifold plates 12 that are generated at different positions that correspond to different pressure chambers 16 by the shape of the common ink chambers 12*a*, 12*b*.

Specifically, the open space chambers 50 are formed so that the sum of the cross-sectional area of the two open-space chambers 50 and the two common ink chambers 12*a*, 12*b* is substantially the same throughout the end portions D, at any optional cross section taken following the direction D2 perpendicular to the longitudinal direction D1. With this configuration, the manifold plate 12 has substantially the same strength regardless of whether the common ink chambers 12*a*, 12*b* have a large or small cross-sectional area.

Figure 13:
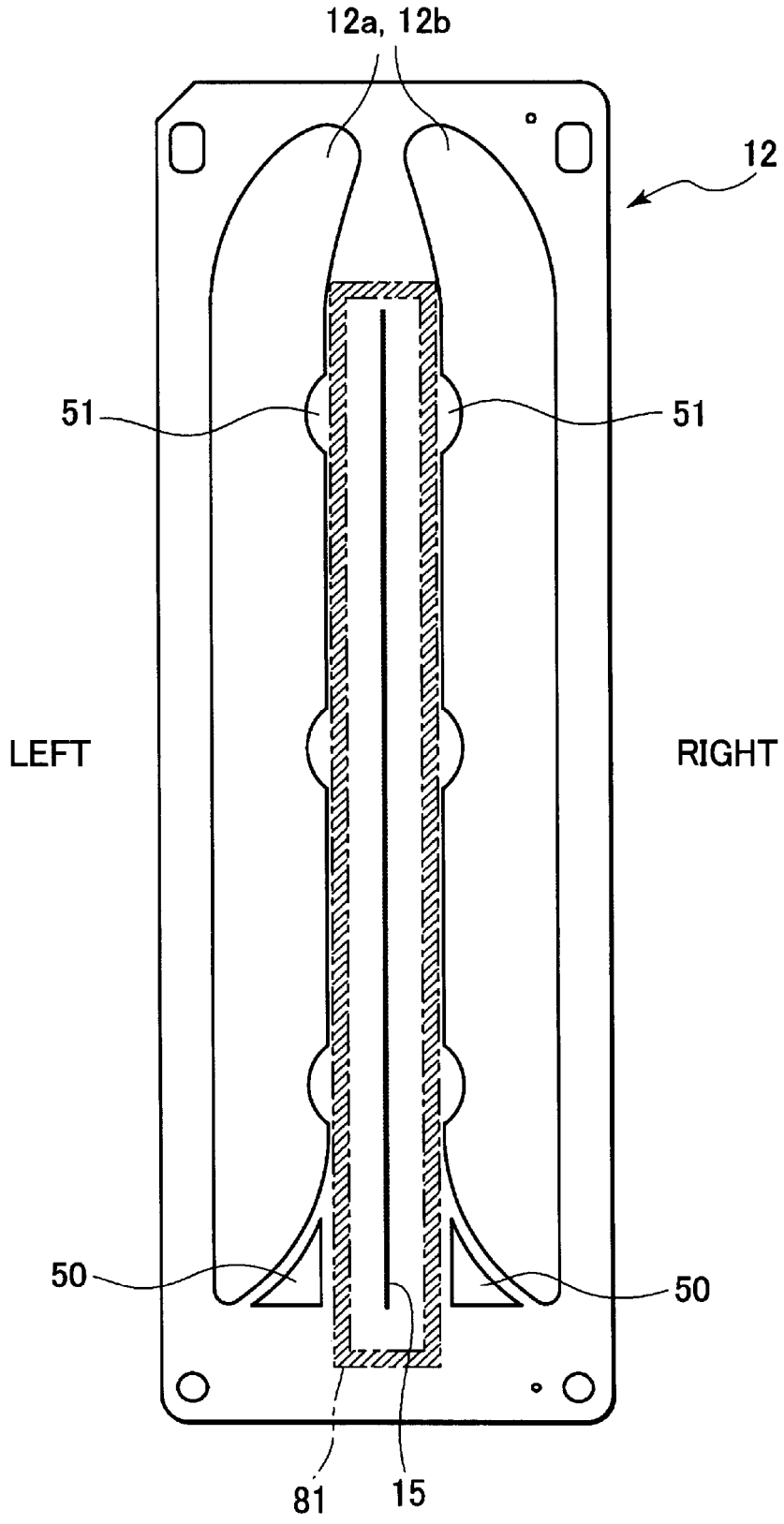
FIG. 13 is a plan view of the manifold plate shown in FIG. 10.

As shown in FIG. 13, the common ink chambers 12*a*, 12*b* include protrusions 51 at positions corresponding to where the cap 81 abuts against the nozzle plate 11. The protrusions 51 protrude from the wall surface of the common ink chamber 12*a*, 12*b* in a direction parallel to the nozzle surface 43 of the nozzle plate 11.

The proper position of the cap 81 abutting against the nozzle surface 43 of the base plate 11, that is, when the cap 81 is not shifted out of position, is shown in hashed line in FIG. 13. As shown, the location of the common ink chambers 12*a*, 12*b* does not take into account any capping margin for the cap 81 of the purging unit 67. The protrusions 51 of the common ink chambers 12*a*, 12*b* are located symmetrically on either side of the rows of nozzles 15. There is a possibility that the cap 81 will be shifted out of position during assembly and for other reasons. When the cap 81 is shifted out of alignment to either the right or left, then the protrusions 51 offer support for the cap 81. Accordingly, the ink jet head 6 can be configured to properly withstand the capping operation without adding any capping margin. Also, because the protrusions 51 are located symmetrically to both sides of the rows of nozzles 15 in the nozzle plate 11, the cap 81 can still be stably supported by the protrusions 51 whether shifted out of position toward either of the common ink chambers 12*a*, 12*b*, which are also located both sides of the rows of nozzles 15.

As shown in FIG. 13, the protrusions 51 have a streamlined shape with respect to flow of ink within the common ink chambers 12*a*, 12*b*. As a result, the ink can flow smoothly within the common ink chambers 12*a*, 12*b*. Also, because the protrusions 51 are provided only at certain portions in the common ink chambers 12*a*, 12*b*, the common ink chambers 12*a*, 12*b* can be provided with sufficient volume.

Figure 14:
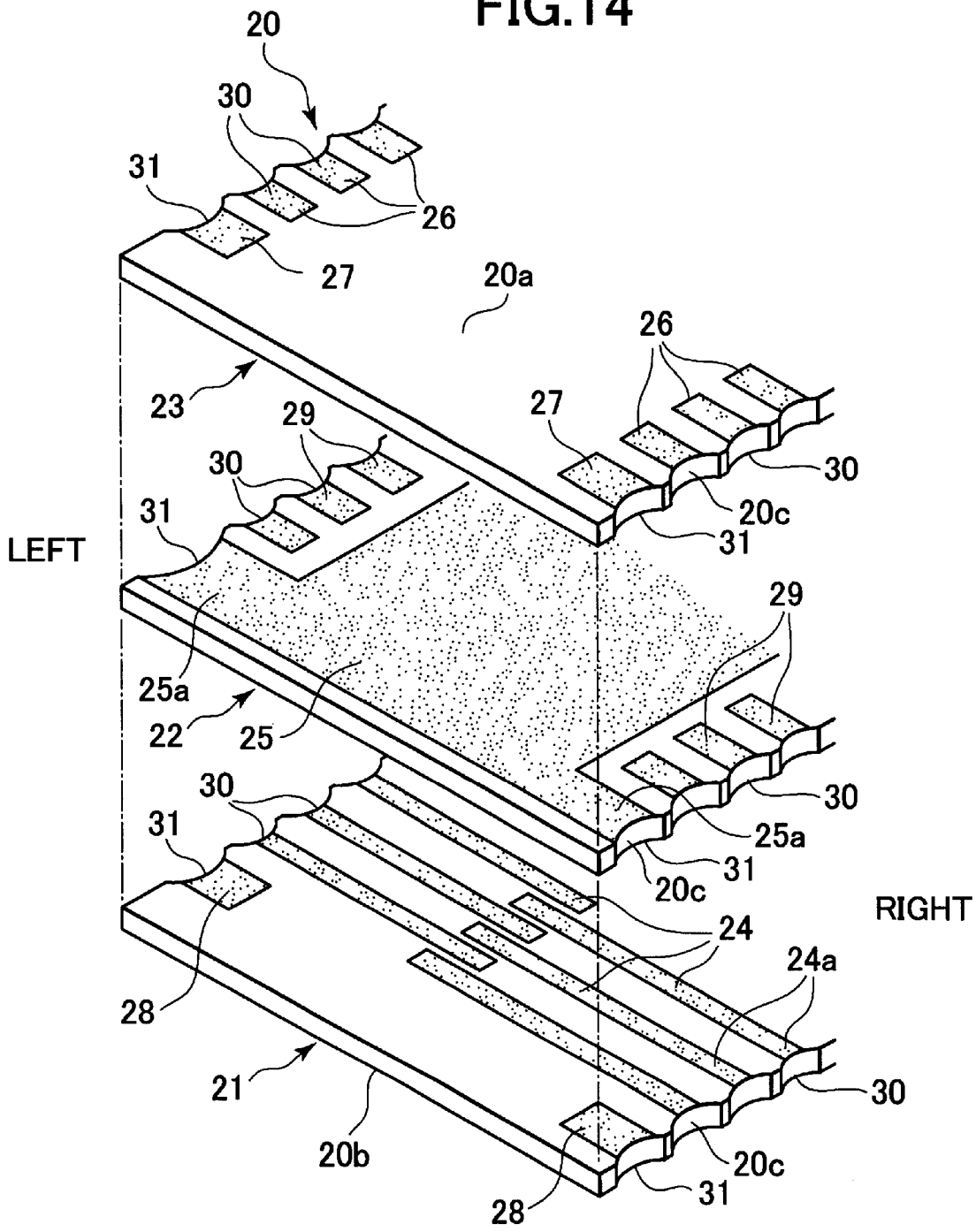
FIG. 14 is an exploded perspective view showing an actuator of the head.

Next, the actuator 20 will be described. As shown in FIG. 14, the actuator 20 includes two piezoelectric sheets 21, 22 and an insulation sheet 23 in a laminated condition. A plurality of drive electrodes 24 is formed on the upper surface of the lowermost piezoelectric sheet 21. The drive electrodes 24 have a narrow elongated shape. The drive electrodes 24 are positioned at locations that correspond to the locations of the pressure chambers 16 of the cavity plate 10 and so have a staggered arrangement. The drive electrodes 24 are formed so that one end 24*a* of each drive electrode 24 is exposed at left and right side surfaces 20*c*, which extend perpendicular to front and rear surfaces 20*a*, 20*b* of the piezoelectric actuator 20.

A common electrode 25 for all of the pressure chambers 16 is provided on the upper surface of the piezoelectric sheet 22. The common electrode 25 is also formed so that one end 25*a* thereof is exposed at the left and right sides 20*c* in the same manner as the one end 24*a* of the drive electrodes 24. Regions of each piezoelectric sheet 22 that are sandwiched between the common electrode 25 and the drive electrodes 24 serve as pressure generating portions for each of the pressure chambers 16.

Surface electrodes 26, which correspond to the drive electrodes 24, and surface electrodes 27, which correspond to the common electrode 25, are formed aligned following along left and right edges 20*c* on the upper surface of the insulation sheet 23, which is the uppermost layer.

First and second set of grooves 30, 31 are formed in the left and right side surfaces 20*c* so as to extend in the direction in which the various plates are stacked. The first grooves 30 are located at positions corresponding to the end 24*a* of the drive electrodes 24 and the second grooves 31 are located at positions corresponding to the end 25*a* of the common electrode 25. As shown in FIG. 9, a side surface electrode 32 that electrically connects corresponding drive electrodes 24 and surface electrode 26 is provided in each first groove 30. Also, a side surface electrode 33 that electrically connects a corresponding surface electrode 27 to the common electrode 25 is provided in each second groove 31. It should be noted that dummy patterns 28, 29 are also provided (FIG. 14).

The piezoelectric actuator 20 is laminated onto the cavity plate 10 with the pressure chambers 16 of the cavity plate 10 aligned with the drive electrodes 24 of the piezoelectric actuator 20. Also, by stacking and pressing the flexible flat cable 20 onto the upper surface 20*a* of the piezoelectric actuator 20, various wiring patterns (not shown) on the flexible flat cable 40 become electrically connected with the upper surface electrodes 26, 27.

Next, a printing operation will be described. Once a paper sheet 62 is supplied from a sheet-supply cassette (not shown) to in between the ink jet head 6 and the platen roller 66, then the carriage 64 is driven by the motor 76 to follow the guide plate 72, and move from the reset position to a predetermined print start position.

A voltage is applied between the common electrode 25 and optional ones of the drive electrodes 24. As a result, the pressure generating portion of the piezoelectric sheet 22, that is, the portion of the piezoelectric sheet 22 that corresponds to the drive electrodes 24 applied with voltage, deforms in the lamination direction, that is, in the direction in which the various plates and piezoelectric sheets are stacked. This deformation reduces the volume in pressure chambers 16 that correspond to the energized drive electrodes 24. The ink in the corresponding pressure chambers 16 is ejected by the consequent increase in pressure in the form of a droplet that lands on a desired location on the paper sheet 62. The sheet 23 is printed on in this manner while the carriage 64 linearly and reciprocally moves following the guide plate 72. Once printing is completed, the carriage 64 and the head unit 63 mounted thereon return to the reset position and the cap 81 covers the nozzles 15.

As described above, the walls that define the common ink chambers 12*a*, 12*b* include protrusions 51. Therefore, even if the cap 81 is shifted out of its optimum positioning, the protrusions 51 support the capping force from pressing action of the cap 81 so that the ink jet head 6 can withstand the capping force from the cap 81 without the need to provide a capping margin. Accordingly, the ink jet head 6 can be produced in a smaller size.

As described above, the plates 11, 12, 12, 13, 14 are laminated one on the other with their surfaces in parallel. Accordingly, planes defined by the plurality of nozzles 15, the plurality of pressure chambers 16, the common ink chambers 12*a*, 12*b*, the open-space chambers 50, the protrusions 51 are all in parallel to each other. Also, because the common ink chambers 12*a*, 12*b*, the open-space chambers 50, and the protrusions 51 are all formed to each manifold plate 12, these are positioned within the same horizontal plane.

As described above, open-space chambers 50 are provided adjacent to the common ink chambers 12*a*, 12*b* in the portion D of the manifold plates 12 where the cross-sectional area the common ink chambers 12*a*, 12*b* decreases. As a result, the manifold plate 12 has substantially the same strength at positions corresponding to all of the pressure chambers 16. Therefore, stress applied to the manifold plate 12 from the pressure generation portions through the pressure chambers 16 is substantially uniform at position in the manifold plate 12 that correspond to pressure chambers 16. Therefore, ink ejection performance is stable.

Also, as described above, the open-space chambers 50 are formed in the manifold plate 12 within the same imaginary plane as the common ink chambers 12*a*, 12*b*. Therefore, stress applied to the manifold plate 12 from the pressure generation portions through the pressure chambers 16 is substantially uniform at position in the manifold plate 12 that correspond to pressure chambers 16. Therefore, ink ejection performance is stable.

The sum of the cross-sectional area of the common ink chambers and the cross-sectional area of the open spaces is substantially the same at any optional position in a direction perpendicular to the direction in which the pressure chambers are aligned. Therefore, the manifold plate 12 has substantially the same strength at positions corresponding to all of the pressure chambers 16 so ink ejection performance is stable.

It should be noted that the common ink chambers 12*a*, 12*b* and the open-space chambers 50 of the manifold plate 12 can be formed by etching processes. If the manifold plate 12 is made from resin, then the common ink chambers 12*a*, 12*b* and the open-space chambers 50 can be formed by pressing or molding techniques.

While the invention has been described in detail with reference to specific embodiments thereof, it would be apparent to those skilled in the art that various changes and modifications may be made therein without departing from the spirit of the invention, the scope of which is defined by the attached claims.

For example, the shape and number of protrusions 51 are not limited to those shown in FIG. 13. For example, only one protrusions 51 can be provided.

Although the embodiment described the pressure generation portions of the actuator 20 as being piezoelectric, other types of pressure generation portions, such as static electric types, can be used instead.

What is claimed is:

1. An ink jet head comprising:

a cavity plate formed with:

a row of plurality of nozzles, the row extending in a first direction;

a plurality of pressure chambers in one-to-one correspondence with the plurality of nozzles;

a common chamber distributing ink to the respective pressure chambers; and a protrusion protruding into the common chamber.

2. The ink jet head according to claim 1, wherein the cavity plate includes:

a nozzle plate formed with the row of a plurality of nozzles;

a base plate formed with the plurality of pressure chambers; and a manifold plate formed with the common chamber and the protrusion.

3. The ink jet head according to claim 2, wherein the manifold plate is laminated between the nozzle plate and the base plate.

4. The ink jet head according to claim 1, wherein the plurality of nozzles define a plane, and the protrusion extends parallel to the plane.

5. The ink jet head according to claim 1, wherein the protrusion has a streamlined shape.

6. The ink jet head according to claim 1, wherein the cavity plate is formed with a pair of common chambers and a plurality of protrusions that protrude into the corresponding common chambers, the plurality of protrusions being formed symmetrical with respect to the row of the plurality of nozzles.

7. The ink jet head according to claim 1, wherein the cavity plate is further formed with an ink supply hole through which ink is supplied into the common ink chamber, and the cavity plate includes a manifold plate formed with the common-chamber, the common chamber having an end portion away from the ink supply hole in the first direction, the end portion having a smaller cross-sectional area with distance from the ink supply hole in the first direction, wherein the manifold plate is formed further with a correcting portion that corrects differences in strength in the manifold plate with respect to the first direction.

8. The ink jet head according to claim 7, wherein the correcting portion is an open-space chamber formed to the manifold plate at a position adjacent to the end portion of the common chamber.

9. The ink jet head according to claim 8, the sum of the cross-sectional area of the open-space chamber and the common chamber is substantially the same throughout the end portion at any optional cross section taken following a second direction perpendicular to the first direction.

10. The ink jet head according to claim 1, further comprising an actuator that selectively applies a pressure to the plurality of pressure chambers.

11. The ink jet printer according to claim 1, wherein the cavity plate is formed further with an ink supply hole through which ink is supplied into the common chamber, and the common chamber has an end portion away from the ink supply hole, the end portion having a smaller cross-sectional area with distance from the ink supply hole in the first direction, and the manifold plate is further formed with a correcting portion that corrects differences in strength in the manifold plate with respect to the first direction.

12. The ink jet printer according to claim 11, wherein the correcting portion is an open-space chamber formed to the manifold plate at a position adjacent to the end of the common chamber.

13. The ink jet head according to claim 1, wherein the common chamber extends in the first direction, allowing ink to flow within the common chamber in the first direction, and the protrusion protrudes into the common chamber so as to narrow the common chamber at the position, the ends of the common chamber being opposed to each other in the first direction.

14. The ink jet head according to claim 13, wherein the common chamber has a width in a second direction perpendicular to the first direction, the second direction being parallel to a longitudinal direction of each pressure chamber, and the protrusion protrudes in the second direction from one side toward another side of the common chamber.

15. The ink jet head according to claim 13, wherein the cavity plate has a nozzle plane defined by the plurality of nozzles, and the plurality of pressure chambers are aligned in the first direction, and the common chamber has an inner surface extending in the first direction between the nozzle plane and the pressure chambers at a position closer to the nozzle plane.

16. An ink jet printer comprising:

the ink jet head of claim 1; and a purging unit including a cap that covers over the row of the nozzles, wherein the protrusion is a support for the cap.

17. The ink jet printer according to claim 16, wherein the plurality of nozzles defines a plane, and the protrusion extends parallel to the plane and has a streamlined shape.

18. The ink jet printer according to claim 16, wherein the cavity plate is formed with a pair of common chambers and a plurality of protrusions that protrude into the corresponding common chambers, the plurality of protrusions and the pair of common chambers being formed symmetrical with respect to the row of the plurality of nozzles.

19. An ink jet head comprising:

a cavity plate formed with:

a row of a plurality of nozzles defining a first plane extending in a first direction and a second direction perpendicular to the first direction;

a plurality of pressure chambers in one-to-one correspondence with the plurality of nozzles;

a common chamber located distributing ink to the respective pressure chambers, the common chamber defining a second plane parallel to the first plane;

an ink supply hole for introducing ink to the common chamber, wherein the common chamber having an end portion with a smaller cross section with a distance from the ink supply hole; and an open-space chamber formed in adjacent to the end portion of the common chamber, the open-space chamber being formed in the second plane defined by the common chamber.

20. The ink jet head according to claim 15, wherein the cavity plate includes:

a nozzle plate formed with the row of the plurality of nozzles;

a base plate formed with the ink supply hole and the plurality of pressure chambers; and a manifold plate formed with the common chamber and the open-space chamber.

21. The ink jet head according to claim 20, wherein the manifold plate is laminated between the orifice plate and the base plate.

22. The ink jet head according to claim 19, the sum of the cross-sectional area of the open-space chamber and the common chamber is substantially the same throughout the end portion at any optional cross section taken following the second direction.

23. The ink jet head according to claim 19, wherein the cavity plate is formed with a pair of common chambers and a pair of open-space chambers.

24. The ink jet head according to claim 19, further comprises an actuator attached to the cavity plate for selectively applying a pressure to the ink in the pressure chamber.

25. The ink jet head according to claim 19, wherein:

the row of the plurality of nozzles extends in the first direction;

the common chamber extends in the first direction, allowing ink to flow within the common chamber in the first direction; and the cavity plate is further formed with a protrusion protruding into the common chamber at a position between ends of the common chamber so as to narrow the common chamber at the position, the ends of the common chamber being opposed to each other in the first direction.

26. The ink jet head according to claim 25, wherein the common chamber has a width in the second direction parallel to a longitudinal direction of each pressure chamber, and the protrusion protrudes in the second direction from one side toward another side of the common chamber.

27. The ink jet head according to claim 25, wherein the plurality of pressure chambers are aligned in the first direction, and the common chamber has an inner surface extending in the first direction between the first plane and the pressure chamber at a position closer to the first plane.

* * * * *